US005203275A

United States Patent [19]

Brauner et al.

[11] Patent Number: 5,203,275

[45] Date of Patent: Apr. 20, 1993

[54] MEANS ATTACHABLE TO AN OUTBOARD MOTOR OR STERN DRIVE UNIT FOR FACILITATING ON-PLANE OPERATION OF A WATERCRAFT

[76] Inventors: Joseph J. Brauner, 16957 Manchester Rd.; John C. Covert, 2531 Estherton Rd., both of Grover, Mo. 63040

[21] Appl. No.: 853,098

[22] Filed: Mar. 18, 1992

[51] Int. Cl.[5] ..... B63B 1/24

[52] U.S. Cl. ..... 114/274; 440/66

[58] Field of Search ..... 440/66, 900; 114/274, 114/275, 276, 277, 278, 270

[56] References Cited

U.S. PATENT DOCUMENTS

| | | | |
|---|---|---|---|
| 4,205,618 | 6/1980 | Olsson | 440/66 |
| 4,352,666 | 10/1982 | McGowan | 440/51 |
| 4,487,152 | 12/1984 | Larson | 114/274 |
| 4,781,632 | 11/1988 | Litjens et al. | 440/66 |
| 4,781,634 | 11/1988 | Harris et al. | 440/66 |
| 4,875,882 | 10/1989 | Plitt et al. | 440/66 |

*Primary Examiner*—Joseph F. Peters, Jr.
*Assistant Examiner*—Stephen P. Avila
*Attorney, Agent, or Firm*—Haverstock, Garrett & Roberts

[57] ABSTRACT

A watercraft performance type device for facilitating the on-plane operation of a watercraft comprising a plate-like member which is specifically designed to be removably attachable to the underside portion of the cavitation plate associated with the lower drive unit of a typical outboard motor or stern drive assembly, the plate-like member including an angularly related tab portion extending downwardly substantially across the rear end portion thereof, an opening strategically positioned for receiving the downwardly extending torque tab commonly associated with most cavitation plates, the torque tab opening being located and dimensioned so as to enable the torque tab to extend therethrough when the plate-like member is attached in operative position to the underside portion of the cavitation plate, and a cut-out arrangement associated with the front end portion of the plate-like member for positioning and locating the same in close abutting relationship with that portion of the lower drive unit located adjacent to and extending below the cavitation plate when the present plate-like member is attached in operative position to the cavitation plate. The present plate-like member also includes a pair of opposed fin-like portions each of which extend outwardly from a respective side portion thereof for improving the overall handling characteristics and lateral stability and control of the watercraft during operation, the present plate-like member being adaptable for use on outboard motors and stern drive units associated with all types of watercraft including watercraft with double stepped hulls as well as inflatables.

17 Claims, 3 Drawing Sheets

MEANS ATTACHABLE TO AN OUTBOARD MOTOR OR STERN DRIVE UNIT FOR FACILITATING ON-PLANE OPERATION OF A WATERCRAFT

The present invention relates generally to a watercraft performance option device and, more particularly, to several embodiments of a plate-like device designed specifically to improve the overall performance, stability and control of the watercraft to which it is attached by enabling such watercraft to achieve an on-plane condition in minimum time, the present plate-like device being removably attachable to the underside portion of the cavitation plate associated with most outboard motors and most inboard/outboard stern drive units. Use of the present device improves the performance and handling characteristics of the watercraft; it reduces wear and tear on the drive unit as well as wear and tear, stress and deformation to the cavitation plate; it does not interfere with torque tab operation; it compliments any motor or outdrive and provides an aesthetically pleasing appearance that is a natural extension of the cavitation plate; it is easy to install; and, most importantly, it brings the watercraft up out-of-the-hole and on-plane in minimum time and with minimum power.

BACKGROUND OF THE INVENTION

Many different types of performance improving devices including a wide variety of hydrofoil and/or stabilizer devices have been constructed and used to improve the overall performance of a particular watercraft. Some of the known hydrofoil/stabilizer devices utilized to facilitate on-plane operation are mounted directly to the stern of a watercraft whereas others are mounted to various portions of an outboard motor or stern drive unit including to the cavitation plate of the lower drive unit. Importantly, however, all of the known prior art devices which attach to the cavitation plate are attachable to either the topside and/or side edge portions of such cavitation plate. These known mounting arrangements cause fatigue and stress problems both with respect to the cavitation plate as well as the hydrofoil/stabilizer device attached thereto in that the upward force generated by the waterflow against the bottom portion of such known devices creates an upward thrust pressure which is constantly pulling the hydrofoil/stabilizer device upward and away from the top and side edge portions of the cavitation plate. This causes considerable stress at the points of joinder and eventually results in cracks in the cavitation plate and ultimate fatigue failure. Also, the known mounting arrangements for attaching the known devices to the topside and/or side edge portions of the cavitation plate do not provide, in many instances, sufficient overlap between the hydrofoil/stabilizer device and the cavitation plate to withstand the separation forces generated during boat operation, particularly at top end speeds. This is not true of the present device which mounts to the underside portion of the cavitation plate substantially across the entire bottom surface area thereof. None of the known prior art devices are attachable to the underside portion of the cavitation plate associated with outboard motors and stern drive units.

Also, many of the known prior art devices which facilitate on-plane boat operation are, in fact, hydrofoils and these devices operate on aerodynamic principles to create a higher pressure on the underside of the hydrofoil surface thereby generating lift which forces the stern of the boat up and the bow down. In order to generate sufficient lift over the top of the hydrofoil device, much higher boat speeds and much higher motor RPMS are required. This usually translates into using substantial throttle, if not full throttle, in order to generate sufficient waterflow over the hydrofoil device to generate sufficient lift to put the watercraft on-plane. This is not true of the present device which does not operate on aerodynamic principles but, instead, operates on the principle that water pressure hitting the bottom portion of the present plate-like device produces a resultant upward force on the plate member which is transferred to the stern of the boat thereby bringing the bow down to an on-plane condition. Since a pressure differential to produce hydrofoil lift is not required between the upper and lower surfaces of the present device, the present device requires less power and less speed to bring a watercraft up out-of-the-hole from a standstill position to an on-plane condition. For these and other reasons, the known prior art devices for facilitating on-plane operation of a watercraft have not been totally satisfactory.

SUMMARY OF THE INVENTION

The present invention overcomes many of the disadvantages and shortcomings associated with the known constructions and teaches the construction and operation of several embodiments of a relatively thin plate-like member which is specifically designed for attachment to the underside portion of the cavitation plate associated with many outboard and stern drive motor units. The present plate-like member includes a V-shaped cut-out arrangement located adjacent its front end portion and an angularly related downwardly extending tab portion associated with its trailing end portion. The V-shaped cut-out is specifically sized and shaped so as to matingly engage that portion of the lower unit extending below the cavitation plate and adjacent thereto. This helps to position and locate the present device during installation and also provides a means for achieving a greater overlap between the present device and the underside portion of the cavitation plate. It also provides an additional fastening area for holding and securing the front end portions of the device to the cavitation plate. The tab portion is angularly oriented downwardly in the neighborhood of approximately 25° so as to direct and optimize the upward force generated by the waterflow hitting the underside surface thereof thereby concentrating full upward force to the transom, even at low RPM. This helps to generate maximum lift at all times to the stern of the boat thereby moving the bow down and allowing the boat to achieve its on-plane condition as soon as possible.

Since the present plate member attaches to the underside portion of the cavitation plate, and since most cavitation plates include an adjustable torque tab extending downwardly therefrom, the present plate member also includes means in the form of an aperture or cut-out which is specifically sized and shaped so as to enable the torque tab to extend therethrough when installed in its operative position. This allows the present plate member to be positioned flush with the underside portion of the cavitation plate and, when installed, the present plate member does not interfere with or otherwise hinder the use and operation of the torque tab. This is important to the present invention since, without this feature, the present plate member could not be directly attached to the underside portion of the cavitation plate in a flush abutting relationship. In this regard, a plurality of apertures are strategically positioned extending through the present plate member for overlaying with the cavitation plate such that fastening means may be inserted therethrough and through corresponding apertures formed in the cavitation plate to securely fasten the present plate member thereto. Elongated slots may be used in place of some or all of the apertures so as to provide adjustment means for positioning and locating the present device in proper orientation with the cavitation plate and the apertures formed therein. This enables a user to adjust and move the present device fore and/or aft relative to the apertures in the cavitation plate to achieve proper positioning and alignment.

The present plate member is preferably made of a relatively thin stainless steel construction for long-lasting durability and strength. Because of its relatively thin construction, the present device substantially minimizes drag and backsplash commonly associated with known prior art devices. In addition, the present plate member is specifically shaped so as to promote better control and side-to-side stability; it substantially eliminates porpoising and cavitation in the prop area; its unique mounting arrangement substantially eliminates separation forces between the present device and the cavitation plate and more evenly distributes all such forces to the underside portion of the cavitation plate; and it substantially eliminates material deformation of the cavitation plate, particularly at high speeds, thereby prolonging its useful life as well as the useful life of the cavitation plate. Also, the manner in which the present device is mounted to the underside portion of the cavitation plate allows the present plate member to become an integral part of the lower unit concentrating the upward force generated thereby at takeoff and allowing a user to plane his/her watercraft at ¼ to ½ throttle thereby increasing safety while saving fuel as well as engine wear.

Several different embodiments of the present invention are disclosed herein depending upon the particular type of outboard motor or stern drive unit to which the present device is attached. It is recognized and anticipated that the present plate-like member can be sized to fit any outboard or stern drive unit regardless of size and/or horsepower.

It is therefore a principal object of the present invention to teach the construction and operation of a device attachable to a boat motor or stern drive unit to facilitate on-plane operation.

Another object is to teach the construction and operation of a plate-like member which is attachable to the underside portion of the cavitation plate associated with most outboard motors or stern drive units to facilitate boat performance.

Another object is to provide a device to facilitate on-plane boat operation which is easy to install and is removably attachable to the underside portion of the cavitation plate.

Another object is to provide a device to facilitate on-plane boat operation which includes means for allowing the torque tab to extend therethrough without interference and/or hinderance thereto.

Another object is to provide a device to facilitate on-plane boat operation which likewise substantially eliminates cavitation around the prop area.

Another object is to provide a device to facilitate on-plane boat operation which is specifically shaped and designed to improve the overall control and handling characteristics of the boat utilizing such device.

Another object is to teach the construction and operation of a device for facilitating on-plane boat operation which is attachable to the cavitation plate in such a manner as to increase the overall effectiveness of such device as well as prolong the useful life of the cavitation plate to which it is attached.

Another object is to provide a device for facilitating on-plane boat operation which includes adjustable means for accommodating attachment of such device to the cavitation plate.

Another object is to teach the construction and operation of a device for facilitating on-plane boat operation which is adaptable for use with a wide variety of outboard motors and stern drive units.

Another object is to teach the construction and operation of a device for facilitating on-plane boat operation which substantially eliminates stress on the lower unit casting to which it is attached.

These and other objects and advantages of the present invention will become apparent to those skilled in the art after considering the following detailed specification in conjunction with the accompanying drawings.

DETAILED DESCRIPTION OF THE INVENTION

Figure 1:
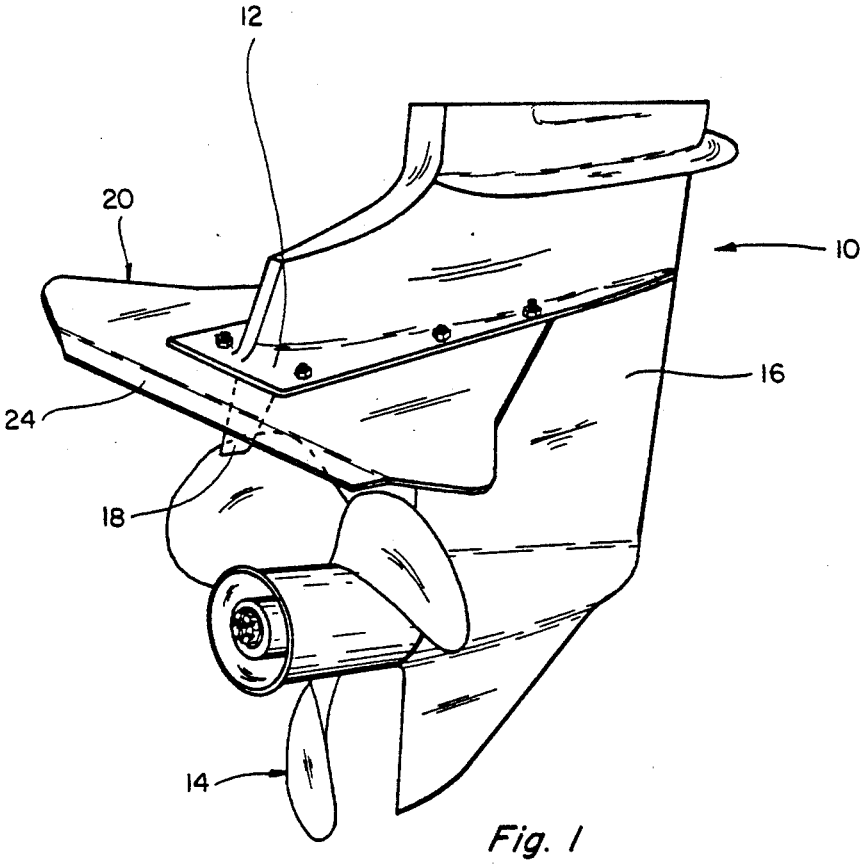
FIG. 1 is a perspective view of the lower drive unit of either an outboard motor or a stern drive unit showing one embodiment of the present plate-like member attached in operative position to the underside portion of the cavitation plate associated therewith.
Figure 3:
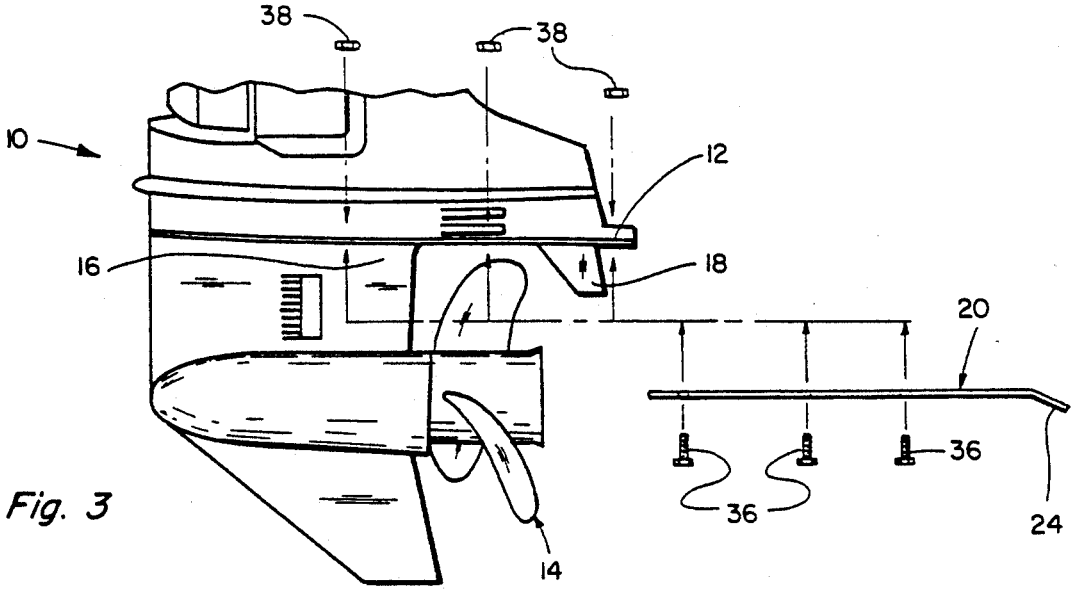
FIG. 3 is a partial exploded side elevational view showing the manner in which the plate-like member of FIG. 2 is maneuvered and positioned for attachment to the underside portion of the cavitation plate.
Figure 4:
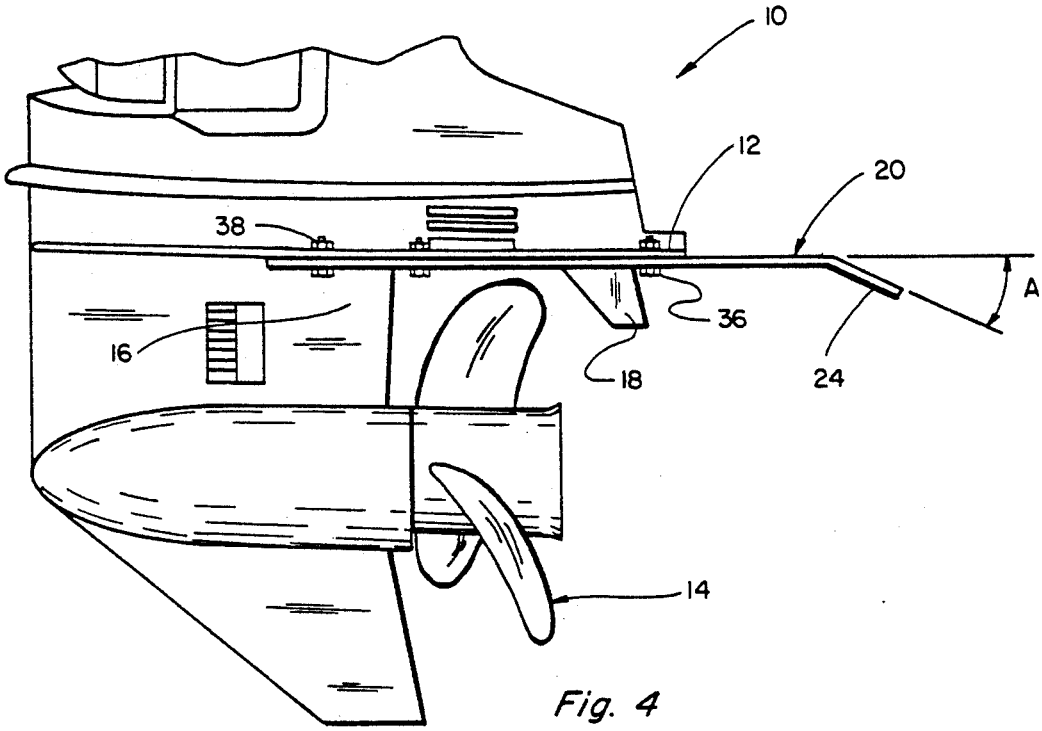
FIG. 4 is a partial side elevational view showing the plate-like member of FIGS. 1-3 attached to the underside portion of the cavitation plate.
Figure 2:
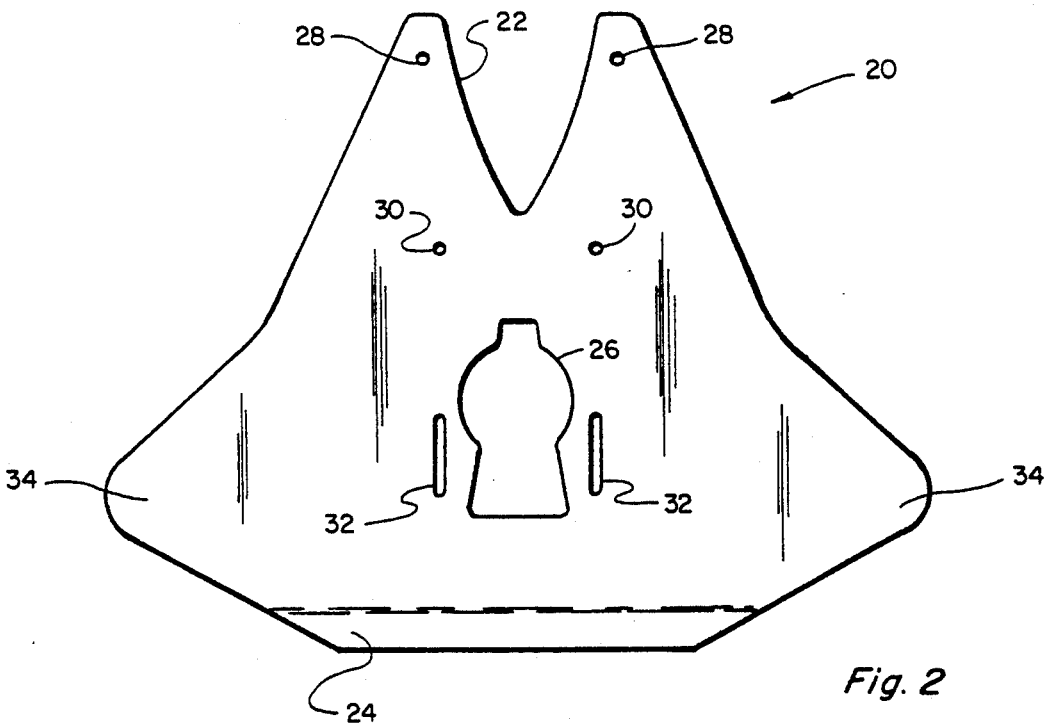
FIG. 2 is a top plan form view of the plate-like member illustrated in FIG. 1.

Referring to the drawings more particularly by reference numbers wherein like numerals refer to like parts, number 20 in FIGS. 1 and 2 identifies one embodiment of the present means for facilitating on-plane boat operation constructed according to the teachings of the present invention. The member 20 is shown in FIGS. 1 and 4 attached in its operative position to the underside portion of the cavitation plate 12 associated with the lower drive unit 10, the lower drive unit 10 being representative of a typical lower unit assembly associated with either an outboard motor or an inboard/outboard stern drive unit. Although different types of lower drive unit assemblies are presently being used on outboard motors and stern drive units and some variations do exist with respect thereto from one manufacturer to another, the lower drive unit 10 illustrated in FIGS. 1, 3 and 4 is representative of many of such lower drive units. Referring to FIGS. 1, 3 and 4, besides including the cavitation plate 12, the lower drive unit 10 also includes a prop assembly 14, a lower unit portion 16 into which the prop assembly is incorporated, and a torque tab 18 which extends downwardly from the underside portion of the cavitation plate 12. The torque tab 18 is usually adjustable and is angularly positionable so as to compensate, at least partially, for the torque developed by the particular drive unit during operation.

The present member 20 is of a relatively thin plate-like construction and is preferably made of stainless steel or some other relatively thin metal or metal alloy capable of providing long-lasting durability and strength. Although a stainless steel construction is generally preferred, it is recognized that other suitable materials of construction such as certain plastic and certain composite materials are available and could equally be employed to fabricate the plate member 20 so long as such materials are relatively strong and durable and are able to withstand the various forces exerted thereagainst during usage.

In its preferred embodiment, the plate member 20 includes a V-shaped cut-out 22 located adjacent its forward edge portion as best shown in FIG. 2, the cut-out 22 being specifically sized and shaped so as to mate and be compatible with the shape and size of that portion 16 of the lower unit 10 extending below the cavitation plate 12 as illustrated in FIGS. 1, 3 and 4. The cut-out 22 helps to properly position and locate the plate member 20 during installation and enables the member 20 to be positioned in tight abutting relationship with lower unit portion 16. The compatible V-shape of the cut-out 22 also enables the correspondingly shaped rear end portion of the lower unit portion 16 to be wedged therewithin thereby providing additional means for holding and securing the front end portion of the plate member 20 in proper position to the underside portion of the cavitation plate 12. This straddle-type arrangement not only provides stability during operation, but it also allows the front end portion of the member 20 to be attached to opposite sides of the cavitation plate 12 as far forward as possible on opposite sides of the lower unit portion 16 as best illustrated in FIGS. 1 and 3. This arrangement further produces a greater overlap between the plate member 20 and the underside portion of the cavitation plate 12 which distributes the forces applied thereagainst more evenly as will be hereinafter further explained. It is recognized and anticipated that the specific shape of the cut-out 22 may be varied depending upon the particular shape and configuration of the lower unit portion 16 against which the member 20 will be positioned and secured as is true of embodiment 40 illustrated in FIG. 5.

The plate member 20 also includes a downwardly extending tab portion 24 as best shown in FIGS. 2 and 4. The tab portion 24 extends substantially along the full length of the trailing edge of the member 20 and is angularly oriented downwardly as shown so as to direct and maximize the upward force generated by the waterflow hitting the underside surface thereof. Because the tab portion 24 is angularly oriented downwardly, the waterflow striking the tab 24 will always have a resultant force which acts upwardly thereby producing an overall upward thrust or force on the plate member 20. This, in turn, pushes the member 20 upwardly against the underside portion of the cavitation plate 12. This upward force is transferred through the cavitation plate 12 to the stern of the boat thereby bringing the bow down to an on-plane condition. This is true even if the present plate member 20 is moving through the water in a substantially flat, horizontal position relative thereto as illustrated in FIG. 4. Obviously, the more the plate member 20 is angularly oriented relative to the surface of the water, such as during takeoff from a standstill position, the greater will be the overall resultant upward force generated to the stern of the boat. The tab portion 24 therefore functions not only to initiate, direct and maximize the upward force generated by moving the plate member 20 through the water, but it also maintains sufficient upward force on the member 20 when the watercraft reaches its on-plane operating condition even if the plate member 20 achieves a substantially flat, level, horizontal position relative to the water surface as illustrated in FIG. 4.

Although it has been found that an angular displacement A of tab portion 24 (FIG. 4) in the neighborhood of approximately 25° provides a generally desirable condition for optimizing and maximizing the upward force generated by the plate member 20 during normal operating conditions of most watercraft, it is also recognized that other angular orientations may likewise provide suitable results for some applications depending upon the particular motor or stern drive unit utilized as well as the speed range and the particular nature of the use of such watercraft. In any event, the tab 24 should be angularly oriented so as to achieve optimum lift at all times to the stern of the boat, even at low RPM.

The plate member 20 also includes means in the form of the aperture or cut-out 26 which is specifically sized, shaped and positioned on the member 20 so as to insertably receive the particular torque tab associated with the cavitation plate 12 such as the downwardly extending torque tab 18 illustrated in FIGS. 1, 3 and 4. The cut-out 26 is strategically positioned on the plate member 20 so as to coincide and register with the torque tab 18 when the plate member 20 is positioned flush against the underside surface of the cavitation plate 12, the torque tab 18 extending through the cut-out 26 as illustrated. Since most cavitation plates include an adjustable torque tab, aperture or cut-out means 26 must be sufficiently sized and shaped so as not to interfere with or otherwise hinder the use and operation of the torque tab 18. It has been found that the keyhole shape of aperture 26 best accommodates the majority of the various torque tab configurations in use today. The keyhole configuration 26 also, importantly, allows the torque tab 18 to be angularly adjusted throughout its entire range of adjustment while extending therethrough, again, without causing interference or hindrance problems. The aperture or cut-out 26 is important and necessary, otherwise the plate member 20 could not be directly attached to the underside portion of the cavitation plate 12.

The maneuvering and positioning of the plate member 20 for engagement with the underside portion of the cavitation plate 12 is illustrated in FIG. 3. This is accomplished by maneuvering the plate member 20 between the prop assembly 14 and the torque tab 18 to a position whereby the torque tab 18 can be positioned extending through the aperture means 26. Once this is accomplished, the plate member 20 can be positioned flush with the underside portion of the cavitation plate 12 and the V-shaped cut-out 22 can be properly positioned and located in close abutting relationship with the lower unit portion 16. At this point, the plate member 20 is ready for final attachment to the cavitation plate 12.

Attachment of the plate member 20 to the underside portion of the cavitation plate 12 is accomplished through the use of a plurality of apertures 28 and 30, and a pair of slots 32, all of which are strategically positioned on the plate member 20 for registering with and overlaying the cavitation plate 12 as best shown in FIG. 2. The apertures and slots 28, 30 and 32 are positioned and located such that when the plate member 20 is placed flush with the underside portion of the cavitation plate 12 in its operative position as best shown in FIGS. 1 and 4, the apertures and slots 28, 30 and 32 register with the cavitation plate 12. Once properly positioned in abutting relationship with the cavitation plate 12, the plate member 20 is used as a guide and template for marking, drilling or otherwise forming corresponding apertures through the cavitation plate of sufficient size to receive therethrough suitable fastening means such as the truss head screw members 36 and attaching nut members 38 illustrated in FIGS. 1, 3 and 4. Failure to use the plate member 20 as a template for locating and drilling the corresponding apertures in the cavitation plate 12 may result in mis-alignment of such apertures during installation. Once these corresponding apertures have been drilled or otherwise formed, the plate member 20 is securely fastened in flush mating relationship to the underside portion of the cavitation plate by way of fastening means 36 and 38 in a conventional manner. The V-shape configuration of cut-out 22 provides maximum overlap with the forward portion of the cavitation plate 12 and enables the apertures 28 to be positioned and located as far forward as possible on the cavitation plate 12. This provides a means for securely fastening the front end portion of the member 20 to the cavitation plate as well as maximizing the overlap between such members.

It is preferred that the head portion of the fastening members 36 be positioned adjacent the underside portion of the plate member 20 and that the fastening nut members 38 be located adjacent the top portion of the cavitation plate 12 as illustrated in FIGS. 1 and 4 as this arrangement presents a substantially smooth flush surface along the underside portion of the plate member 20 thereby minimizing drag when moved through the water. Once the plate member 20 is securely fastened to the underside portion of the cavitation plate 12 as just described, the present device is ready for use.

It is important to recognize that use of the slots 32 allows a user to locate the rear mounting hardware in the best possible position with respect to the cavitation plate 12 as the corresponding apertures formed therethrough can be located anywhere along the length of the slot. This provides some adjustment for positioning and locating the corresponding apertures in the cavitation plate. This also allows a user to move the present plate member 20 fore and/or aft relative to any apertures formed in the cavitation plate to achieve proper positioning and alignment. It is recognized that elongated slots such as the slots 32 may likewise be used in place of the apertures 28 and/or 30 to provide additional flexibility and adjustability in positioning and locating the present device 20 in proper relationship with the cavitation plate 12. It is also anticipated that any plurality of apertures and/or slots in any combination may be utilized to securely fasten the present plate member 20 to the underside portion of the cavitation plate 12. Still further, it is likewise anticipated that any such slots utilized with the plate member 20 may be angularly oriented relative to the trailing edge portion thereof other than as illustrated in the accompanying drawings.

The present plate member 20 also importantly includes side fin-like portions 34 which extend sidewardly from the main body portion thereof as illustrated in FIG. 2. The fin-like portions 34 improve the side-to-side lateral stability of the watercraft as it moves through the water and they function to improve the overall handling characteristics and control of the watercraft during operation. The particular size and shape of the fin-like portions 34 will dictate the specific amount of improved handling characteristics associated with the use of the present device 20. In this regard, it is recognized and anticipated that the fin-like portions 34 may be varied in size and shape without departing from the spirit and scope of the present invention.

Since the present plate member 20 mounts directly to the underside portion of the cavitation plate 12 substantially across the entire bottom surface area thereof as best illustrated in FIG. 1, all of the upward force generated by movement of the plate member 20 through the water as previously explained is transferred to and evenly distributed across the entire bottom surface of the cavitation plate 12. This provides maximum transfer of the resultant upward forces generated through use of the present member 20 to the stern of the boat thereby bringing the bow down to an on-plane condition in minimum time. Also, importantly, since the present plate member 20 is mounted to the underside portion of the cavitation plate and the forces generated during its use push the member 20 against the cavitation plate, considerably less stress and fatique problems occur at the points of joinder. This is true because all such forces generated are evenly distributed across the entire bottom surface area of the cavitation plate 12 as previously explained. This enhances the overall useful life of both the member 20 as well as the cavitation plate 12 and substantially minimizes fatigue or other material failure. The present mounting arrangement also substantially eliminates the fatigue and separation problems associate with the known prior art devices since the known devices are attached to the upper and/or side edge portions of the cavitation plate as previously explained. Those types of separation and fatigue problems are obviated by the fact that the present plate member 20 is attachable directly to the underside portion of the cavitation plate in flush abutting relationship therewith. Still further, because of its unique mounting arrangement and its close proximity to the prop area 14, the present member 20 likewise substantially eliminates cavitation in the prop area due to the fact that it compliments and forms a natural extension of the cavitation plate 12 and as such constantly provides waterflow in and around the prop area. The particular mounting arrangement of the present member 20 also substantially minimizes backsplash and porpoising.

Figure 5:
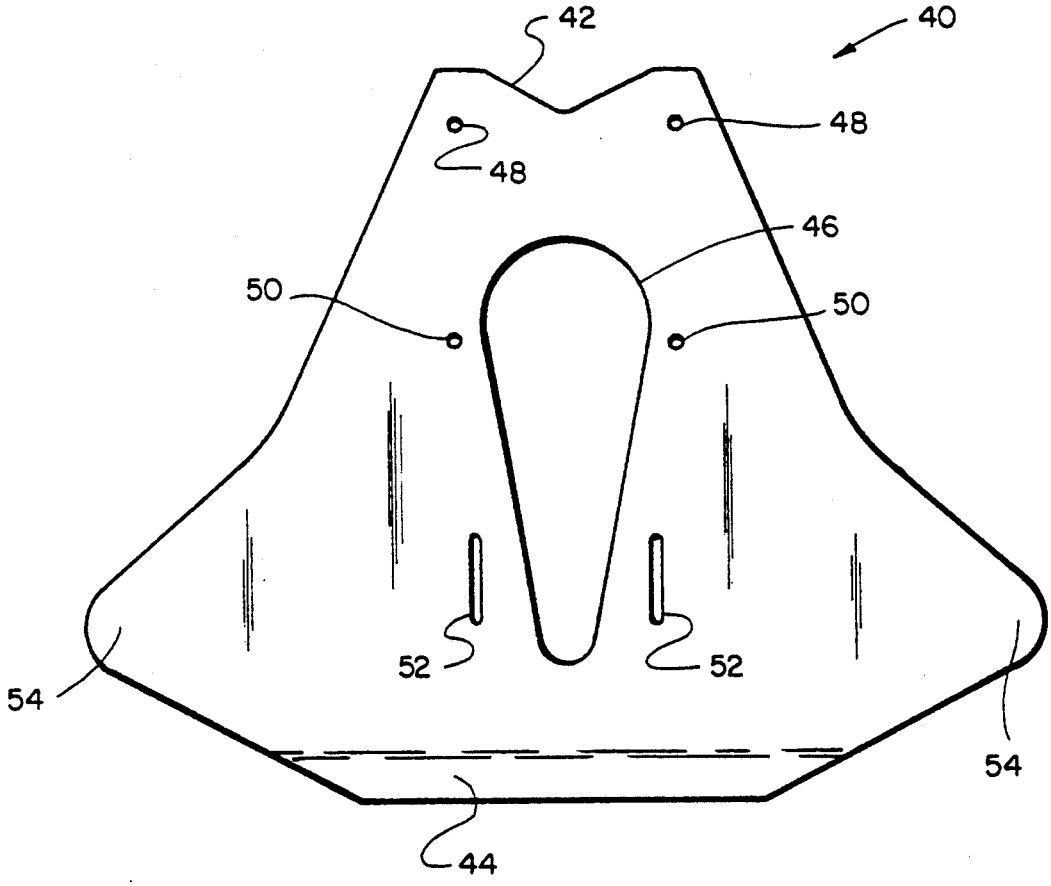
FIG. 5 is a top plan form view of another embodiment of the present plate-like member constructed according to the teachings of the present invention.

FIG. 5 discloses another embodiment 40 of the present plate member which is specifically adaptable for use in conjunction with Force and Chrysler outboard motors and stern drive units. Because of the different configuration of the lower drive unit and torque tab arrangement associated with these particular types of units, the plate member 40 has been specifically designed and shaped to accommodate these variations. The plate member 40 is similar in construction and operation to the plate member 20 illustrated in FIG. 2 and, like the plate member 20, includes a cut-out 42 located adjacent its forward edge portion, a downwardly extending tab portion 44 extending substantially along the full length of the trailing edge portion thereof, aperture or cut-out means 46 for insertably receiving the downwardly extending torque tab, a plurality of apertures 48 and 50 and slots 52 for attaching the member 40 to the underside portion of the cavitation plate, and the side fin-like portions 54 for stability and control, all of which constructional features operate substantially identical to those illustrated and described with respect to plate member 20. The plate member 40 differs from plate member 20 in that the cut-out 42 and aperture means 46 are sized and shaped differently so as to be compatible with the somewhat different lower unit and torque tab configuration associated with the Force and Chrysler drive units. More particularly, the cut-out 42 is specifically sized and shaped so as to mate and be compatible with the correspondingly shaped rear end portion of the Force and Chrysler lower units. The cut-out 42 is still V-shaped in configuration, however, such V-shape is considerably shallower in depth than the V-shape of cut-out 22. Although the depth of the V-shape cut-out 42 does not provide the same degree of overlap and straddle-type arrangement as cut-out 22, it nevertheless operates and functions in the same manner.

Similarly, the size and shape of the aperture or cut-out 46 is considerably different from the keyhole shape of aperture 26, the cut-out 46 being specifically sized, shaped and positioned on the plate member 40 so as to insertably receive the particular torque tab associated with the cavitation plates utilized on the Force and Chrysler drive units. Like cut-out 26, cut-out 46 enables the adjustable torque tab associated with the Force and Chrysler drive units to be fully operational and adjustable while extending therethrough. In all other respects, the plate member 40 is similar in construction and operation to plate member 20.

Since the plate members 20 and 40 are relatively thin in construction and have relatively smooth top and bottom surfaces, movement of such devices through the water produce minimum drag. Also, importantly, since the present plate members 20 and 40 are not hydrofoils and do not operate on aerodynamic principles, the production of lift due to a pressure differential between the upper and lower surfaces thereof is not required as previously explained. This means that the present devices require less power and less forward speed in order to achieve their objective, that is, to bring a watercraft up out-of-the-hole from a standstill position to an on-plane condition in minimum time. This not only saves wear and tear on the engine and lower drive unit, it also saves fuel and promotes safety in that the bow of the watercraft stays down improving driver visibility. Also, use of the present devices enables a user to cruise at lower RPM in an on-plane condition.

The present devices are adaptable for use on outboard motors and stern drive units associated with all types of watercraft including watercraft with double stepped hulls as well as inflatables. Also, importantly, the overall dimensions of the present devices as well as the particular location and configuration of the various constructional features associated therewith such as the cut-outs 22 and 42, tab portions 24 and 44, aperture means 26 and 46, the openings and slots 28–32 and 48–52, and side fin-like portions 34 and 54 are subject to wide variations and each may be sized and shaped into a wide variety of different sizes and configurations without impairing the teachings and practices of the present invention. It is also recognized that a wide variety of cooperatively engageable joinder means other than the fastening members 36 and 38 illustrated in the accompanying drawings may be utilized to securely fasten the present devices to the underside portion of the cavitation plate. Still other joinder or attachment arrangements are likewise anticipated. It goes without saying that the present devices are likewise obviously attachable to the underside portion of those cavitation plates which do not include a torque tab.

Thus, there has been shown and described several embodiments of a novel watercraft performance option device which is attachable to most outboard motors and stern drive units, which devices facilitate on-plane boat operation and fulfill all of the objects and advantages sought therefor. Many changes, modifications, variations and other uses and applications of the present constructions will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. Means removably attachable to the underside portion of a cavitation plate located on the lower drive unit of an outboard motor or stern drive unit for facilitating the on-plane operation of a watercraft, said removably attachable means comprising a relatively thin plate member having front, side and rear portions, a tab portion extending from the rear portion of said plate member, said tab portion being angularly related to the plane of said plate member, means adjacent the front portion of said plate member for positioning and locating said front portion with that portion of the lower drive unit located immediately adjacent to and extending below the cavitation plate, said means enabling the front portion of said plate member to be compatible with the shape of said lower drive unit portion when positioned and located in abutting relationship thereagainst, and attachment means for enabling said plate member to be attached directly to the underside portion of said cavitation plate in flush abutting relationship thereto, said plate member being in substantial overlap with the underside portion of said cavitation plate when attached in operative position thereto.

2. The means defined in claim 1 wherein said tab portion is angularly oriented downwardly relative to the rear portion of said plate member in the neighborhood of approximately 25°.

3. The means defined in claim 1 wherein said plate member includes a substantially V-shaped cut-out.

4. The means defined in claim 1 wherein the cavitation plate includes a torque tab extending downwardly from its underside portion, said plate member further including aperture means for receiving said torque tab, said aperture means being positioned and located to enable said torque tab to extend therethrough when said plate member is attached to the underside portion of said cavitation plate.

5. The means defined in claim 4 wherein said torque tab is angularly adjustable through some predetermined range of angular movement, said aperture means being dimensioned to allow full range of movement of said torque tab when said torque tab extends therethrough.

6. The means defined in claim 1 wherein said plate member further includes a fin portion extending outwardly from each respective side portion thereof.

7. The means defined in claim 1 wherein said attachment means for enabling said plate member to be attached directly to the underside portion of said cavitation plate in flush abutting relationship thereto includes a plurality of openings extending through said plate member, said openings being positioned and located on said plate member so as to overlay the cavitation plate when said plate member is placed in operative position adjacent the underside portion thereof.

8. The means defined in claim 7 wherein at least some of said plurality of openings are elongated slots.

9. In a watercraft propulsion system having a propeller assembly, a cavitation plate located above the propeller assembly, and a torque tab extending downwardly from the underside portion of the cavitation plate, means removably attachable to the cavitation plate for facilitating the on-plane operation of a watercraft, said means comprising a substantially planar member having front, side and rear portions, a tab portion extending substantially across the rear edge portion of said planar member, said tab portion being angularly related downwardly relative to said rear edge portion, means for enabling the front portion of said planar member to mate with that portion of the propulsion system located immediately adjacent to and below said cavitation plate when positioned thereagainst, cut-out means extending through said planar member, said cut-out means being located and dimensioned so as to enable the torque tab associated with said cavitation plate to extend therethrough when said planar member is positioned in close abutting relationship thereto, and means for enabling said planar member to be attached in flush abutting relationship to the underside portion of said cavitation plate with the torque tab extending through said cut-out means, said attachment means including a plurality of apertures extending through said planar member, each of said apertures being positioned and located so as to overlay the cavitation plate when said planar member is placed in operative position adjacent the underside portion thereof, said planar member extending substantially across the underside portion of said cavitation plate when attached thereto.

10. The means defined in claim 9 wherein said substantially planar member includes a pair of opposed fin portions, each of said fin portions extending outwardly from a respective side portion of said planar member.

11. The means defined in claim 9 wherein said cut-out means is substantially keyhole shaped in configuration.

12. The means defined in claim 9 wherein said planar member is made of a metal material.

13. A relatively thin plate member removably attachable to the underside portion of a cavitation plate commonly associated with an outboard motor or stern drive unit for facilitating the on-plane operation of a watercraft, said outboard motor or stern drive unit including a propeller assembly and having a torque tab extending downwardly from the underside portion of the cavitation plate, said plate member having front, side and rear end portions and including a cut-out portion located adjacent the front end portion thereof, said cut-out portion being positioned and dimensioned so as to enable the front end portion of said plate member to mate with that portion of the outboard motor or stern drive unit located immediately adjacent to and extending below the cavitation plate, a tab portion extending substantially across the rear end portion of said plate member and being angularly related thereto, said tab portion being located in spaced relationship above and aft of the propeller assembly when said plate member is attached in operative position to said cavitation plate, an opening positioned and located through said plate member for receiving the torque tab when said plate member is likewise attached in operative position to the underside portion of said cavitation plate, a pair of opposed fin portions each extending outwardly from a respective side portion of said plate member, means for enabling said plate member to be attached to the underside portion of said cavitation plate, and means providing some adjustment for properly aligning said plate member with said cavitation plate for attachment thereto, said plate member being in substantial overlap with the underside portion of said cavitation plate when attached thereto.

14. The plate member defined in claim 13 wherein the torque tab associated with said cavitation plate is angularly adjustable through a predetermined range of angular movement, said opening positioned and located through said plate member for receiving the torque tab being shaped and dimensioned so as to allow full range of movement of said torque tab therewithin when said plate member is attached in operative position to the underside portion of said cavitation plate.

15. The plate member defined in claim 13 wherein said tab portion is angularly displaced in the neighborhood of approximately 25° relative to the rear end portion of said plate member.

16. The plate member defined in claim 13 wherein the cut-out portion located adjacent the front end portion of said plate member is substantially V-shaped in configuration.

17. The plate member defined in claim 13 wherein said means providing some adjustment for properly aligning said plate member with said cavitation plate for attachment thereto includes a plurality of elongated slots extending through said plate member, each of said elongated slots being positioned and located so as to overlay the cavitation plate when said plate member is placed in operative position adjacent the underside portion thereof.

* * * * *